US007242368B2

(12) United States Patent
Thevenot et al.

(10) Patent No.: US 7,242,368 B2
(45) Date of Patent: Jul. 10, 2007

(54) MULTIBEAM ANTENNA WITH PHOTONIC BANDGAP MATERIAL

(75) Inventors: Marc Thevenot, Peyrilhac (FR); Régis Chantalat, Limoges (FR); Bernard Jecko, Rilhac-Rancon (FR); Ludovic Leger, Limoges (FR); Thierry Monediere, Limoges (FR); Patrick Dumon, Vigoulet-Auzil (FR)

(73) Assignees: Centre National de la Recherche Scientifique (C.N.R.S.), Paris (FR); Centre National d'Etudes Spatiales, Paris (FR)

( * ) Notice: Subject to any disclaimer, the term of this patent is extended or adjusted under 35 U.S.C. 154(b) by 15 days.

(21) Appl. No.: 10/532,641

(22) PCT Filed: Oct. 23, 2003

(86) PCT No.: PCT/FR03/03147

§ 371 (c)(1),
(2), (4) Date: Dec. 22, 2005

(87) PCT Pub. No.: WO2004/040696

PCT Pub. Date: May 13, 2004

(65) Prior Publication Data

US 2006/0132378 A1 Jun. 22, 2006

(30) Foreign Application Priority Data

Oct. 24, 2002 (FR) ..... 02 13326
Jul. 31, 2003 (FR) ..... 03 09473

(51) Int. Cl.
*H01Q 15/02* (2006.01)
*H01Q 1/38* (2006.01)

(52) U.S. Cl. ..... 343/909; 343/700 MS

(58) Field of Classification Search ..... 343/909, 343/700 MS, 779
See application file for complete search history.

(56) References Cited

U.S. PATENT DOCUMENTS 4,236,161 A 11/1980 Ohm
6,262,830 B1 7/2001 Scalora
6,975,269 B2 * 12/2005 Jecko et al. ..... 343/700 MS (Continued)

FOREIGN PATENT DOCUMENTS

FR 2 801 428 5/2001

OTHER PUBLICATIONS

Chung K B et al:, "Defect modes in a two-dimensional square-lattice photonic crystal", Optics Communicaitons, North-Holland Publishing Co. Amsterdam, NL, vol. 209, No. 4-6, 15 aout 2002 (Aug. 15, 2002), pp. 229-235, XP004375303, ISSN: 0030-4018 le document en entier.

(Continued)

*Primary Examiner*—Hoanganh Le
(74) *Attorney, Agent, or Firm*—Young & Thompson

(57) ABSTRACT

A multibeam antenna includes: a photonic bandgap material (20) having at least one band gap; at least one periodicity defect so as to produce at least one narrow bandwidth inside the at least one band gap of the photonic bandgap material, and excitation elements (50 to 43) for enabling electromagnetic waves to be received inside the at least one narrow bandwidth. The excitation elements are mutually arranged so as to generate radiating spots (46 to 49) partly overlapping on one surface of the photonic bandgap material.

8 Claims, 7 Drawing Sheets

U.S. PATENT DOCUMENTS

| | | | | |
|---|---|---|---|---|
| 7,116,202 | B2 * | 10/2006 | Alexopoulos et al. | 336/200 |
| 7,136,028 | B2 * | 11/2006 | Ramprasad et al. | 343/909 |
| 2006/0097917 | A1 * | 5/2006 | Thevenot et al. | 343/700 MS |
| 2006/0125713 | A1 * | 6/2006 | Thevenot et al. | 12/119.5 |

OTHER PUBLICATIONS

Thevenot M et al:, "Directive Photonic-Bandgap Antennas", IEEE Transactions on Microwave Theory and Techniques, IEEE Inc. New York, US, vol. 47, No. 11, Nov. 1999, pp. 2115-2121, XP000865109, ISSN: 0018-9480, figures, 10, 11.

Shi B et al: "Defective Photonic Crystals With Greatly Enhanced Second-Harmonic Generation", Optics Letterts, Optical Society of America, Washington, US, vol. 26, No. 15, 1 aout 2001 (Aug. 1, 2001), pp. 1194-1196, XP001110592 ISSN: 0146-9592, le document en entier.

* cited by examiner

MULTIBEAM ANTENNA WITH PHOTONIC BANDGAP MATERIAL

The invention relates to a multibeam antenna comprising:

a PBG material (Photonic Bandgap) suitable for the spatial and frequency-wise filtering of electromagnetic waves, this PBG material exhibiting at least one stopband and forming an exterior surface radiating in emission and/or in reception, at least one defect of periodicity of the PBG material in such a way as to create at least one narrow passband within said at least one stopband of this PBG material, and an excitation device suitable for emitting and/or receiving electromagnetic waves inside said at least one narrow passband created by said at least one defect.

Multibeam antennas are much used in space applications and in particular in geostationary satellites for transmitting to the earth's surface and/or for receiving information from the earth's surface. For this purpose they comprise several radiating elements each generating an electromagnetic wave beam spaced from the other beams. These radiating elements are, for example, placed in proximity to the focus of a parabola forming a reflector of electromagnetic wave beams, the parabola and the multibeam antenna being housed in a geostationary satellite. The parabola is intended to direct each beam onto a corresponding zone of the earth's surface. Each zone of the earth's surface illuminated by a beam of the multibeam antenna is commonly referred to as a zone of coverage. Thus, each zone of coverage corresponds to a radiating element.

At present, the radiating elements used are known by the term "horns" and the multibeam antenna equipped with such horns is dubbed a horn antenna. Each horn produces a substantially circular radiating spot forming the base of a conical beam radiated in emission or in reception. These horns are disposed side by side in such a way as to make the radiating spots as close as possible to one another.

FIG. 1A diagrammatically represents a multibeam antenna with horns in an end-on view in which seven squares F1 to F7 indicate the footprint of seven horns disposed adjoining one another. Seven circles S1 to S7, each inscribed in one of the squares F1 to F7, represent the radiating spots produced by the corresponding horns. The antenna of FIG. 1A is placed at the focus of a parabola of a geostationary satellite intended to transmit information on French territory.

FIG. 1B represents −3 dB zones of coverage C1 to C7, each corresponding to a radiating spot of the antenna of FIG. 1A. The center of each circle corresponds to a point of the earth's surface where the power received is a maximum. The outline of each circle delimits a zone inside which the power received on the earth's surface is greater than half the maximum power received at the center of the circle. Although the radiating spots S1 to S7 are practically adjoining, they produce mutually disjoint −3 dB zones of coverage. The regions situated between the −3 dB zones of coverage are referred to here as reception nulls. Each reception null therefore corresponds to a region of the earth's surface where the power received is less half the maximum power received. In these reception nulls, the power received may turn out to be insufficient for a ground receiver to be able to operate correctly.

To solve this problem of reception nulls, it has been proposed to mutually overlap the radiating spots of the multibeam antenna. A partial end-on view of such a multibeam antenna comprising several radiating spots that overlap is illustrated in FIG. 2A. In this figure, only two radiating spots SR1 and SR2 have been represented. Each radiating spot is produced from seven independent and mutually distinct radiation sources. The radiating spot SR1 is formed from the radiation sources SdR1 to SdR7 disposed side by side adjoining one another. A radiating spot SR2 is produced from radiation sources SdR1, SdR2, SdR3 and SdR7 and from radiation sources SdR8 to SdR10. The radiation sources SdR1 to SdR7 are able to work at a first working frequency so as to create a first beam of electromagnetic waves that is substantially uniform at this first frequency. The radiation sources SdR1 to SdR3 and SdR7 to SdR10 are able to work at a second working frequency in such a way as to create a second beam of electromagnetic waves that is substantially uniform at this second working frequency. Thus, the radiation sources SdR1 to SdR3 and SdR7 are suitable for working simultaneously at the first and at the second working frequency. The first and the second working frequencies are different from one another so as to limit the interference between the first and the second beams produced.

Thus, in such a multibeam antenna, radiation sources, such as the radiation sources SdR1 to 3, are used both to create the radiating spot SR1 and the radiating spot SR2, thereby producing an overlapping of these two radiating spots SR1 and SR2. An illustration of the disposition of the −3 dB zones of coverage created by a multibeam antenna exhibiting overlapping radiating spots is represented in FIG. 2B. Such an antenna makes it possible to considerably reduce the reception nulls, or even to cause them to disappear. However, partly on account of the fact that a radiating spot is formed from several independent and mutually distinct radiation sources, at least some of which are also used for other radiating spots, this multibeam antenna is more complex to control than the conventional horn antennas.

The invention aims to remedy this drawback by proposing a simpler multibeam antenna with overlapping radiating spots.

Its subject is therefore an antenna such as defined above, characterized:

in that the excitation device is suitable for working simultaneously at least around a first and a second distinct working frequency;

in that the excitation device comprises a first and a second distinct and mutually independent excitation element, each suitable for emitting and/or receiving electromagnetic waves, the first excitation element being suitable for working at the first working frequency and the second excitation element being suitable for working at the second working frequency;

in that the or each defect of periodicity of the PBG material forms a leaky resonant cavity exhibiting a constant height in a direction orthogonal to said exterior radiating surface, and determined lateral dimensions parallel to said exterior radiating surface;

in that the first and the second working frequencies are suitable for exciting the same resonant mode of a leaky resonant cavity, this resonant mode being established in an identical manner regardless of the lateral dimensions of the cavity, in such a way as to create on said exterior surface respectively a first and a second radiating spot, each of these radiating spots representing the origin of a beam of electromagnetic waves radiated in emission and/or in reception by the antenna, in that each of the radiating spots exhibits a geometrical center whose position is dependent on the position of the excitation element which gives rise thereto and whose surface area is greater than that of the radiating element giving rise thereto, and in that the first and the second excitation elements are placed one with respect to the other in such a way that the first and the second radiating spots are disposed on the exterior surface of the PBG material side by side and overlap partially.

In the multibeam antenna described hereinabove, each excitation element produces a single radiating spot forming the base or cross section at the origin of an electromagnetic wave beam. Thus, from that point of view, this antenna is comparable to conventional horn antennas where a horn produces a single radiating spot. The control of this antenna is therefore similar to that of a conventional horn antenna. Moreover, the excitation elements are placed in such a way as to overlap the radiating spots. This antenna therefore exhibits the advantages of a multibeam antenna with overlapping radiating spots without the complexity of the control of the excitation elements having been increased relative to that of horned multibeam antennas.

According to other characteristics of a multibeam antenna in accordance with the invention:

each radiating spot is substantially circular, the geometrical center corresponding to a maximum of power emitted and/or received and the periphery corresponding to a power emitted and/or received equal to a fraction of the maximum power emitted and/or received at its center, and the distance, in a plane parallel to the exterior surface, separating the geometrical centers of the two excitation elements, is strictly less than the radius of the radiating spot produced by the first excitation element plus the radius of the radiating spot produced by the second excitation element, the geometrical center of each radiating spot is placed on the line orthogonal to said exterior radiating surface and passing through the geometrical center of the excitation element giving rise thereto, the first and the second excitation elements are placed inside one and the same cavity, the first and the second working frequencies are situated inside the same narrow passband created by this same cavity, the first and the second excitation elements are each placed inside distinct resonant cavities, and the first and the second working frequencies are suitable for each exciting a resonant mode independent of the lateral dimensions of their respective cavity, a reflector plane of electromagnetic radiation associated with the PBG material, this reflector plane being deformed in such a way as to form said distinct cavities, the or each cavity is of parallelepipedal shape.

The invention will be better understood on reading the description which will follow, given merely by way of example, and while referring to the drawings, in which.

Figure 1A:
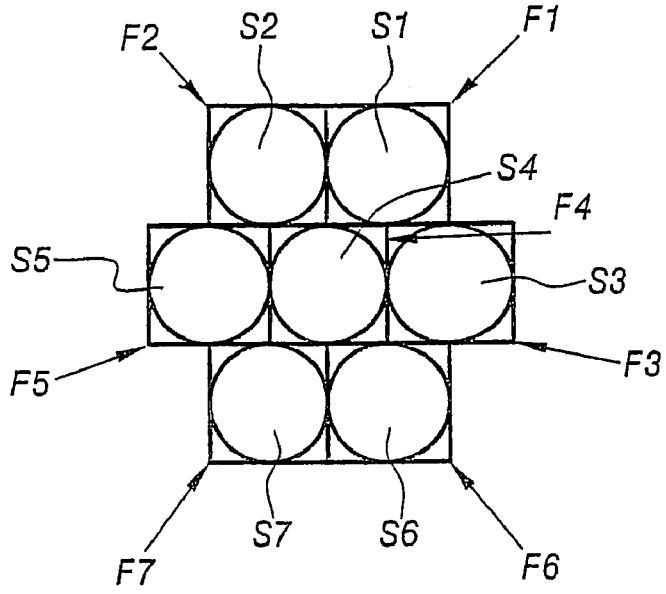
FIGS. 1A, 1B, 2A and 2B represent known multibeam antennas together with the resulting zones of coverage.
Figure 1B:
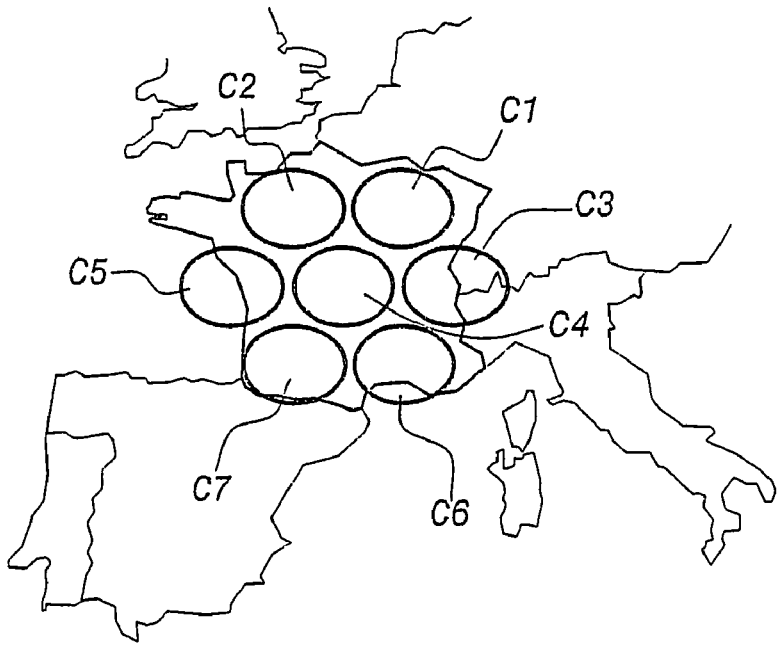
Figure 2A:
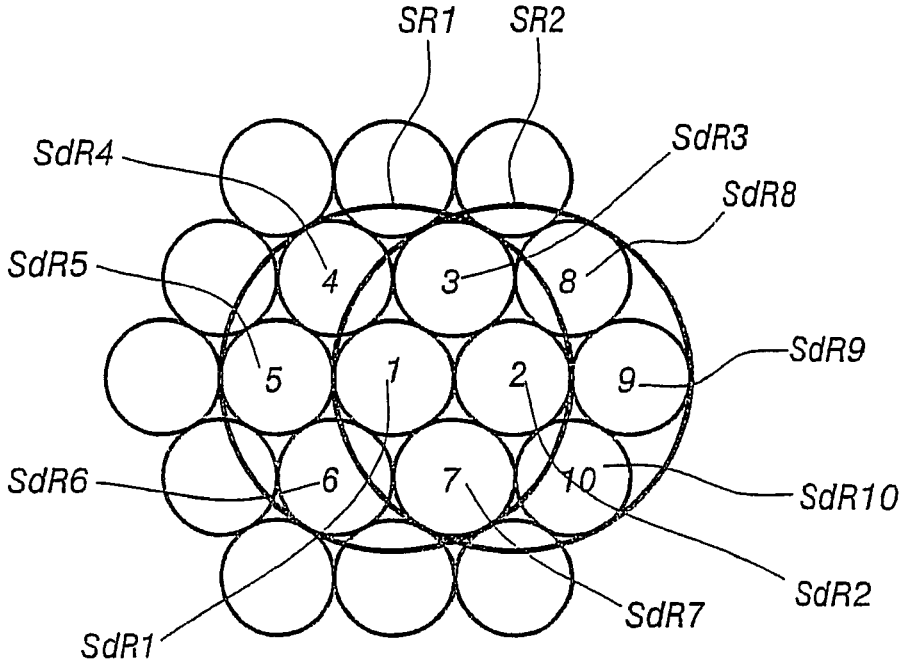
Figure 2B:
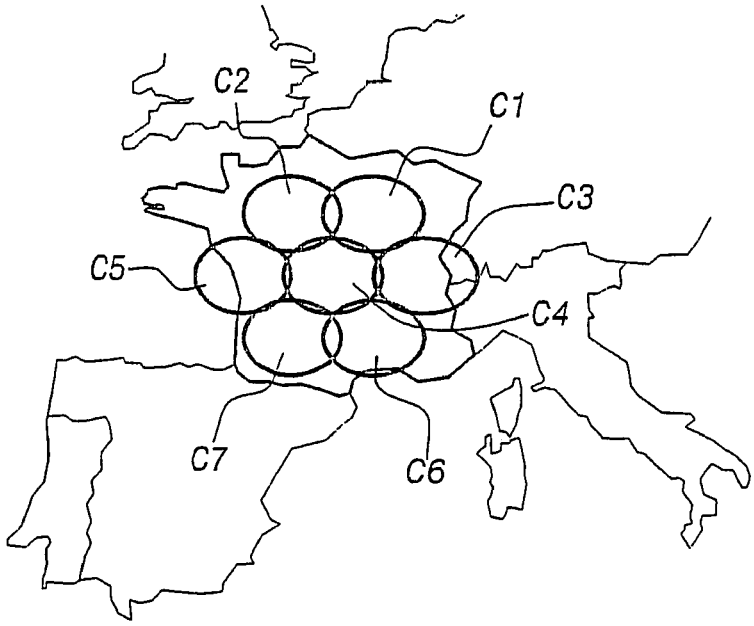
Figure 3:
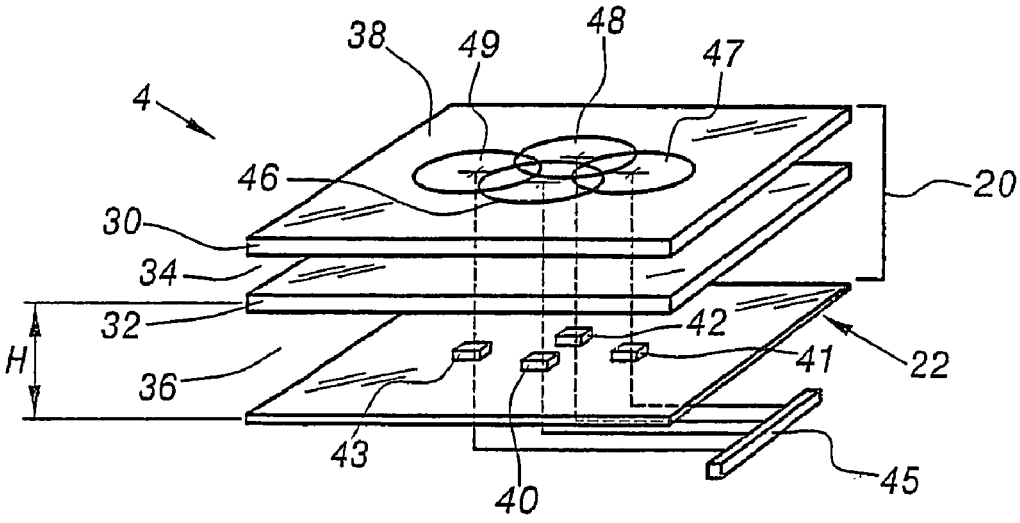
FIG. 3 is a perspective view of a multibeam antenna in accordance with the invention.

FIG. 3 represents a multibeam antenna 4. This antenna 4 is formed of a photonic bandgap material 20 or PBG material associated with a metallic plane 22 reflecting electromagnetic waves.

PBG materials are known and the design of a PBG material such as the material 20 is, for example, described in patent application FR 99 14521. Thus, only the specific characteristics of the antenna 4 with respect to this state of the art will be described here in detail.

It is recalled that a PBG material is a material which possesses the property of absorbing certain frequency ranges, that is to say of prohibiting any transmission in said aforementioned frequency ranges. These frequency ranges form what is referred to here as a stopband.

Figure 4:
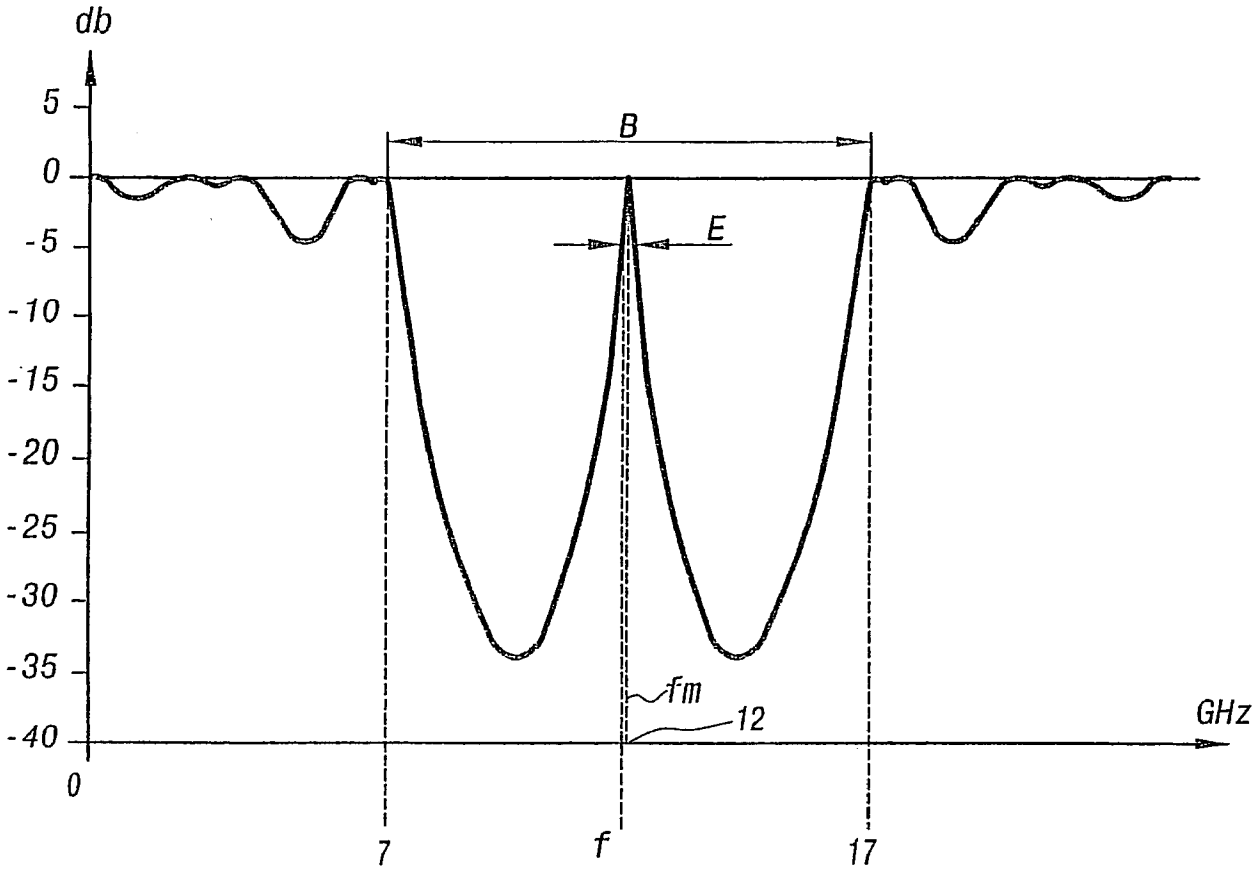
FIG. 4 is a graphic representing the transmission coefficient of the antenna of FIG. 3.

A stopband B of the material 20 is illustrated in FIG. 4. This FIG. 4 represents a curve representing the variations in the transmission coefficient expressed in decibels as a function of the frequency of the electromagnetic wave emitted or received. This transmission coefficient is representative of the energy transmitted from one side of the PBG material relative to the energy received on the other side. In the case of the material 20, the stopband B or absorption band B extends substantially from 7 GHz to 17 GHZ.

The position and the width of this stopband B is dependent only on the properties and characteristics of the PBG material.

The PBG material generally consists of a periodic array of dielectric of variable permittivity and/or permeability. Here, the material 20 is formed from two sheets 30, 32 made from a first magnetic material such as aluminum and from two sheets 34 and 36 formed from a second magnetic material such as air. The sheet 34 is interposed between the sheets 30 and 32, while the sheet 36 is interposed between the sheet 32 and the reflector plane 22. The sheet 30 is disposed at one end of this stack of sheets. It exhibits an exterior surface 38 opposite its surface in contact with the sheet 34. This surface 38 forms a radiating surface in emission and/or in reception.

In a known manner, the introduction of a break into this geometrical and/or radioelectric periodicity, such a break also being referred to as a defect, makes it possible to engender a defect of absorption and therefore the creation of a narrow passband within the stopband of the PBG material. The material is, under these conditions, called a PBG material with defects.

Here, a break in geometrical periodicity is created by choosing the height or thickness H of the sheet 36 greater than that of the sheet 34. In a known manner, and in such a way as to create a narrow passband E (FIG. 4) substantially at the middle of the passband B, this height H is defined by the following relation:

$$H=0.5\times\lambda/\sqrt{\epsilon_r\times\mu_r}$$

where:

$\lambda$ is the wavelength corresponding to the median frequency $f_m$ of the passband E, $\epsilon_r$ is the relative permittivity of air, and $\mu_r$ is the relative permeability of air.

Here, the median frequency $f_m$ is substantially equal to 12 GHz.

The sheet 36 forms a leaky parallelepipedal resonant cavity whose height H is constant and whose lateral dimensions are defined by the lateral dimensions of the PBG material 20 and of the reflector 22. These sheets 30 and 32, as well as the reflector plane 22, are rectangular and of identical lateral dimensions. Here, these lateral dimensions are chosen in such a way as to be several times greater than the radius R defined by the following empirical formula:

$$G_{dB} \geq 20\log\frac{\pi\varphi}{\lambda} - 2.5 \quad (1)$$

where:

$G_{dB}$ is the desired gain in decibels of the antenna, $\Phi$=2 R, $\lambda$ is the wavelength corresponding to the median frequency $f_m$.

By way of example, for a gain of 20 dB, the radius R is substantially equal to 2.15 $\lambda$.

In a known manner, a parallelepipedal resonant cavity such as this exhibits several families of resonant frequencies. Each family of resonant frequencies is formed by a fundamental frequency and its harmonics or integer multiples of the fundamental frequency. Each resonant frequency of one and the same family excites the same resonant mode of the cavity. These resonant modes are known by the terms resonant modes $TM_0$, $TM_1$, . . . , $TM_i$, . . . . These resonant modes are described in greater detail in the document by F. Cardiol, "Electromagnétisme, traité d'Electricité, d'Electronique et d'Electrotechnique", Ed. Dunod, 1987.

It is recalled here that the resonant mode $TM_0$ is capable of being excited by a range of excitation frequencies that is close to a fundamental frequency $f_{m0}$. In a similar manner, each mode $TM_1$ is capable of being excited by a range of excitation frequencies that is close to a fundamental frequency $f_{m1}$. Each resonant mode corresponds to a particular radiation pattern of the antenna and to an emission and/or reception radiating spot formed on the exterior surface 38. The radiating spot is here the zone of the exterior surface 38 containing the whole set of points where the power radiated in emission and/or in reception is greater than or equal to half the maximum power radiated from this exterior surface by the antenna 4. Each radiating spot admits a geometrical center corresponding to the point where the radiated power is substantially equal to the maximum radiated power.

Figure 5:
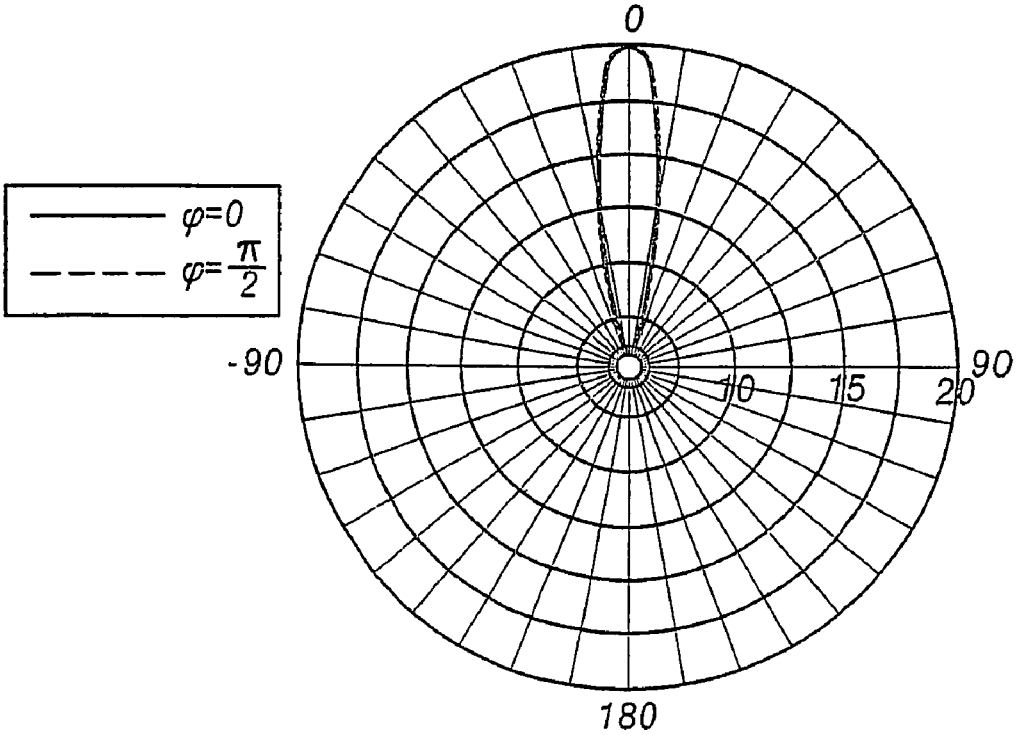
FIG. 5 is a graphic representing the radiation pattern of the antenna of FIG. 3.

In the case of the resonant mode $TM_0$, this radiating spot is inscribed within a circle whose diameter $\Phi$ is given by formula (1). For the resonant mode $TM_0$, the radiation pattern is here highly directional along a direction perpendicular to the exterior surface 38 and passing through the geometrical center of the radiating spot. The radiation pattern corresponding to the resonant mode $TM_0$ is illustrated in FIG. 5.

The frequencies $f_{mi}$ are placed inside the narrow passband E.

Finally, four excitation elements 40 to 43 are placed side by side in the cavity 36 on the reflector plane 22. In the example described here, the geometrical centers of these excitation elements are placed at the four corners of a diamond, the dimensions of whose sides are strictly less than 2R.

Each of these excitation elements is suitable for emitting and/or receiving an electromagnetic wave at a working frequency $f_{Ti}$ different from that of the other excitation elements. Here, the frequency $f_{Ti}$ of each excitation element is close to $f_{m0}$ so as to excite the resonant mode $TM_0$ of the cavity 36. These excitation elements 40 to 43 are linked to a conventional generator/receiver 45 of electrical signals intended to be transformed by each excitation element into an electromagnetic wave and vice versa.

These excitation elements are, for example, constituted by a radiating dipole, a radiating slot, a radiating plate probe or a radiating patch. The lateral footprint of each radiating element, that is to say in a plane parallel to the exterior surface 38, is strictly less than the surface area of the radiating spot to which it gives rise.

The manner of operation of the antenna of FIG. 3 will now be described.

In emission, the excitation element 40, activated by the generator/receiver 45, emits an electromagnetic wave at a working frequency $f_{T0}$ and excites the resonant mode $TM_0$ of the cavity 36. The other radiating elements 41 to 43 are, for example, simultaneously activated by the generator/receiver 45 and do likewise respectively at the working frequencies $f_{T1}$, $f_{T2}$ and $f_{T3}$.

It has been discovered that, for the resonant mode $TM_0$, the radiating spot and the corresponding radiation pattern are independent of the lateral dimensions of the cavity 36. Specifically, the resonant mode $TM_0$ is dependent only on the thickness and the nature of the materials of each of the sheets 30 to 36 and is established independently of the lateral dimensions of the cavity 36 when they are several times greater than the radius R defined above. Thus, several resonant modes $TM_0$ may be established simultaneously alongside one another and hence simultaneously generate several radiating spots disposed side by side. This is what occurs when the excitation elements 40 to 43 excite, each at different points in space, the same resonant mode. Consequently, the excitation by the excitation element 40 of the resonant mode $TM_0$ is manifested by the appearance of a substantially circular radiating spot 46 whose geometrical center is placed vertically plumb with the geometrical center of the element 40. In a similar manner, the excitation by the elements 41 to 43 of the resonant mode $TM_0$ is manifested by the appearance, vertically plumb with the geometrical center of each of these elements, respectively of radiating spots 47 to 49. The geometrical center of the element 40 being at a distance strictly less than 2R from the geometrical center of the elements 41 and 43, the radiating spot 46 partly overlaps the radiating spots 47 and 49 corresponding respectively to the radiating elements 41 and 43. For the same reasons, the radiating spot 49 partly overlaps the radiating spots 46 and 48, the radiating spot 48 partly overlaps the radiating spots 49 and 47 and the radiating spot 47 partly overlaps the radiating spots 46 and 48.

Each radiating spot corresponds to the base or cross section at the origin of a radiated beam of electromagnetic waves. Thus, this antenna operates in a similar manner to the known multibeam antennas with overlapping radiating spots.

The manner of operation of the antenna in reception follows from that described in emission. Thus, for example, if an electromagnetic wave is emitted toward the radiating spot 46, the latter is received in the surface area corresponding to the spot 46. If the wave received is at a frequency lying in the narrow passband E, it is not absorbed by the PBG material 20 and it is received by the excitation element 40. Each electromagnetic wave received by an excitation element is transmitted in the form of an electrical signal to the generator/receiver 45.

Figure 6:
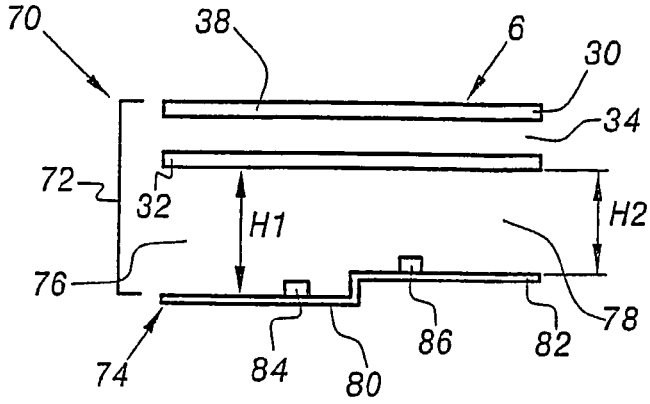
FIG. 6 represents a second embodiment of a multibeam antenna in accordance with the invention.
Figure 7:
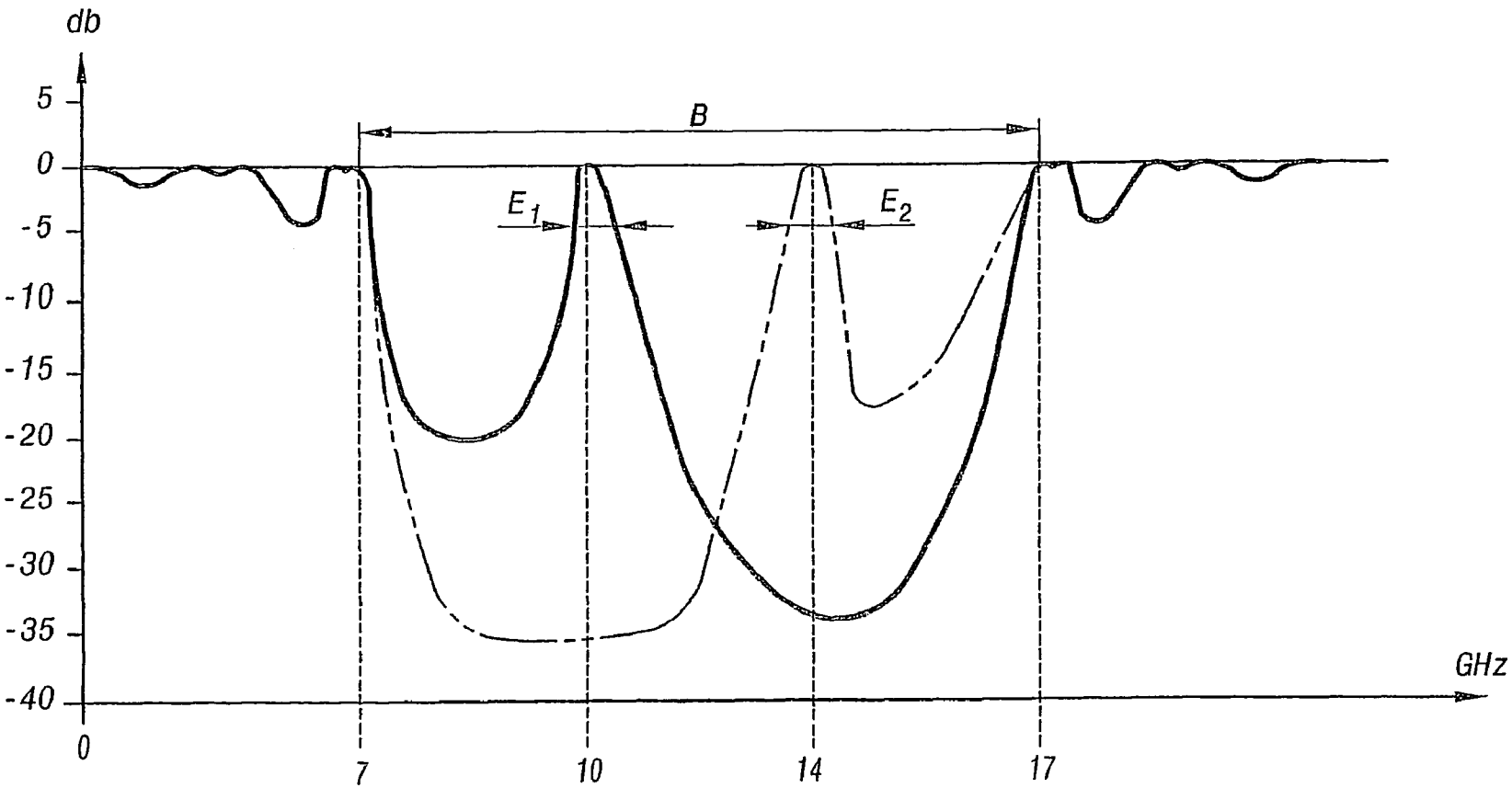
FIG. 7 represents the transmission coefficient of the antenna of FIG. 6.
Figure 9:
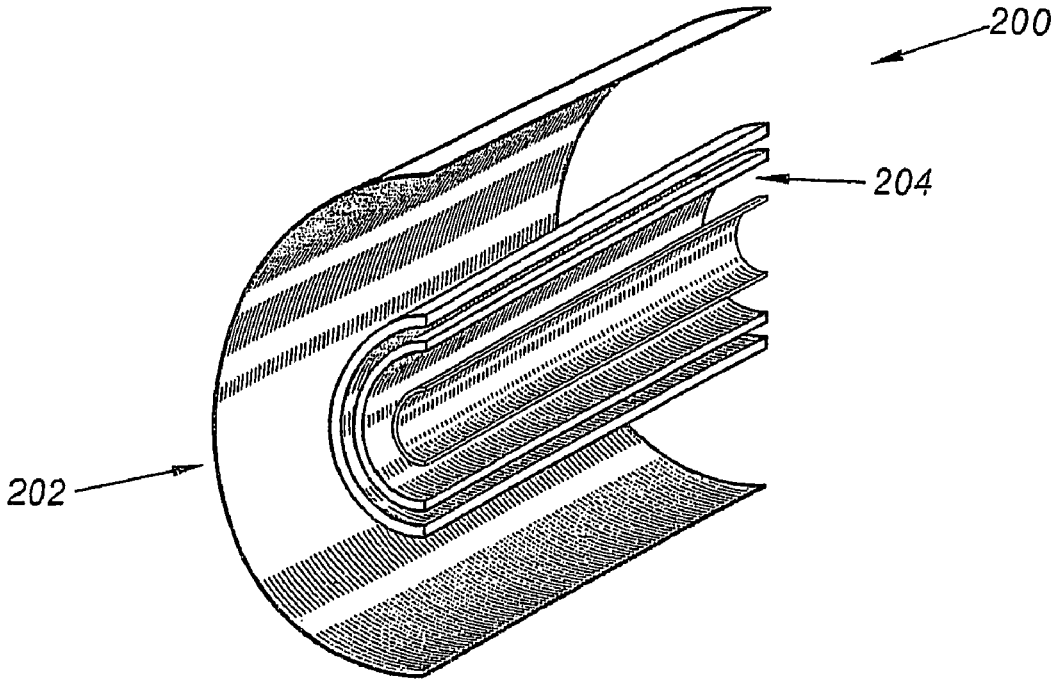
FIG. 9 is an illustration of a semicylindrical antenna in accordance with the invention.

FIG. 6 represents an antenna 70 made from a PBG material 72 and on the basis of a reflector 74 of electromagnetic waves and FIG. 7 the evolution of the transmission coefficient of this antenna as a function of frequency.

The PBG material 72 is, for example, identical to the PBG material 20 and exhibits the same stopband B (FIG. 7). The sheets, already described with regard to FIG. 3, forming this PBG material bear the same numerical references.

The reflector 74 is formed, for example, from the reflector plane 22 deformed in such a way as to divide the cavity 36 into two resonant cavities 76 and 78 of different heights. The constant height $H_1$ of the cavity 76 is determined in such a way as to place, within the stopband B, a narrow passband $E_1$ (FIG. 7), for example, around the frequency of 10 GHz. In a similar manner, the height $H_2$ of the resonant cavity 78 is determined so as to place, within the same stopband B, a narrow passband $E_2$ (FIG. 7), for example centered around 14 GHz. The reflector 74 here is composed of two reflector half-planes 80 and 82 disposed in tiers and connected together electrically. The reflector half-plane 80 is parallel to the sheet 32 and spaced from it by the height $H_1$. The half-plane 82 is parallel to the sheet 32 and spaced from it by the constant height $H_2$.

Finally, an excitation element 84 is disposed in the cavity 76 and an excitation element 86 is disposed in the cavity 78. These excitation elements 84, 86 are, for example, identical to the excitation elements 40 to 43 with the exception of the fact that the excitation element 84 is able to excite the resonant mode $TM_0$ of the cavity 76, while the excitation element 86 is able to excite the resonant mode $TM_0$ of the cavity 78.

In this embodiment, the horizontal distance, that is to say parallel to the sheet 32, separating the geometrical center of the excitation elements 84 and 86, is strictly less than the sum of the radii of two radiating spots produced respectively by the elements 84 and 86.

The manner of operation of this antenna 70 is identical to that of the antenna of FIG. 3. However, in this embodiment, the working frequencies of the excitation elements 84 and 86 are situated in respective narrow passbands $E_1$, $E_2$. Thus, in contradistinction to the antenna 4 of FIG. 3, the working frequencies of each of these excitation elements are separated from one another by a large frequency interval, for example, here, 4 GHz. In this embodiment, the positions of the passbands $E_1$, $E_2$ are chosen in such a way as to be able to use prescribed working frequencies.

Figure 8:
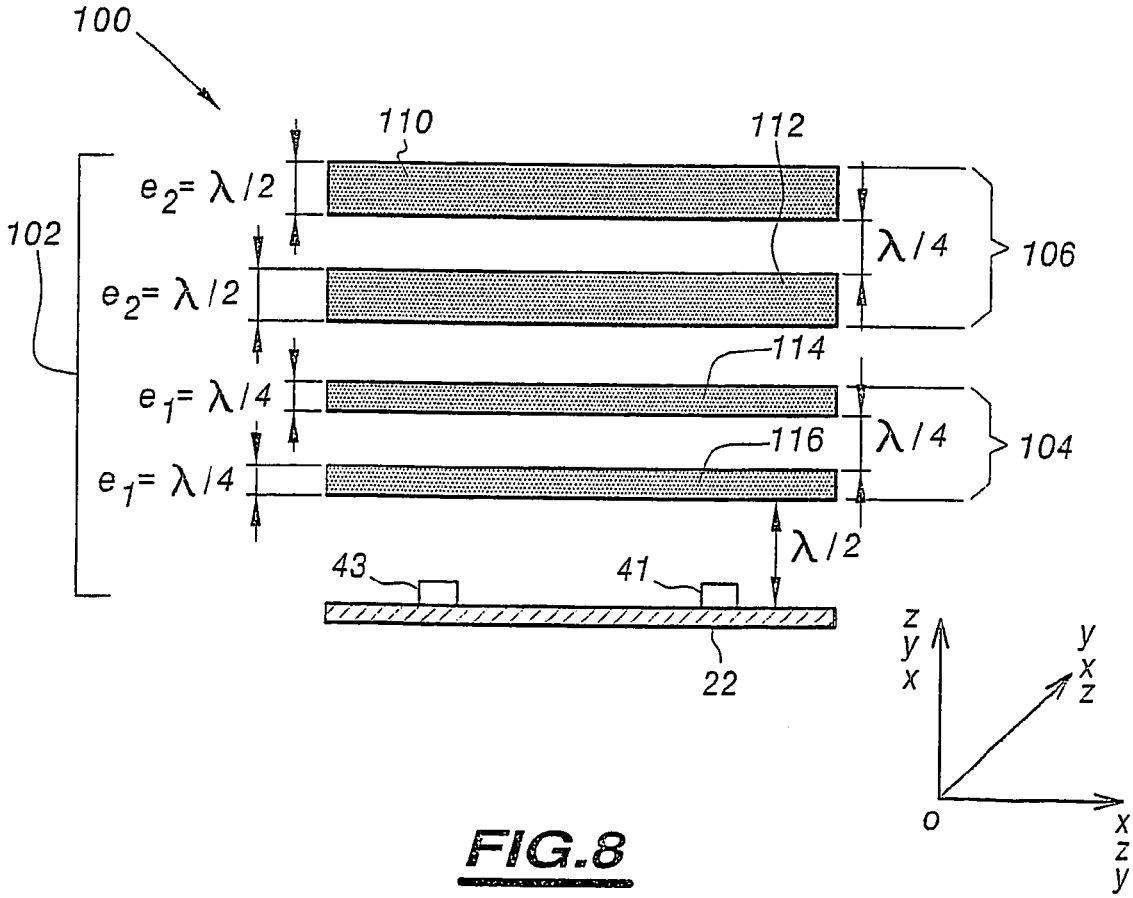
FIG. 8 represents a third embodiment of a multibeam antenna in accordance with the invention.

FIG. 8 represents a multibeam antenna 100. This antenna 100 is similar to the antenna 4 with the exception of the fact that the PBG material with single-defect 20 of the radiating device 4 is replaced with a PBG material 102 with several defects. In FIG. 8., the elements already described with regard to FIG. 4 bear the same numerical references.

The antenna 100 is represented in section through a sectional plane perpendicular to the reflector plane 22 and passing through the excitation elements 41 and 43.

The PBG material 102 comprises two successive clusters 104 and 106 of sheets made from a first dielectric material. The clusters 104 and 106 are overlaid in the direction perpendicular to the reflector plane 22. Each cluster 104, 106 is formed, by way of nonlimiting example, respectively by two sheets 110, 112 and 114, 116 parallel to the reflector plane 22. Each sheet of a cluster has the same thickness as the other sheets of this same cluster. In the case of the cluster 106, each sheet has a thickness $e_2=\lambda/2$ where $\lambda$ designates the wavelength of the median frequency of the narrow band created by the defects of the PBG material.

Each sheet of the cluster 104 has a thickness $e_1=\lambda/4$.

The calculation of these thicknesses $e_1$ and $e_2$ follows from the teaching disclosed in French patent 99 14521 (2 801 428).

Between each sheet of the PBG material 102 with defect is interposed a sheet of a second dielectric material, such as air. The thickness of these sheets separating the sheets 110, 112, 114 and 116 is equal to $\lambda/4$.

The first sheet 116 is disposed facing the reflector plane 22 and separated from this plane by a sheet of a second dielectric material of thickness $\lambda/2$ so as to form a leaky resonant parallelepidal cavity. Preferably, the consecutive thickness $e_i$ of the sheets of dielectric material of each group of sheets of dielectric material is in geometrical progression with ratio q in the direction of the successive clusters 104, 106.

Moreover, in the embodiment described here, by way of nonlimiting example, the number of overlaid clusters is equal to 2 so as not to overburden the drawing, and the geometrical progression ratio is likewise taken equal to 2. These values are not limiting.

This overlaying of clusters of PBG material having different magnetic permeability, dielectric permittivity and thickness $e_i$ characteristics increases the width of the narrow passband created within the same stopband of the PBG material. Thus, the working frequencies of the radiating elements 40 to 43 are chosen to be spaced further apart than in the embodiment of FIG. 3.

The manner of operation of this radiating device 100 follows directly from that of the antenna 4.

As a variant, the radiation emitted or received by each excitation element is polarized in a different direction from that used by the neighboring excitation elements. Advantageously, the polarization of each excitation element is orthogonal to that used by the neighboring excitation elements. Thus, the interference and coupling between neighboring excitation elements are limited.

As a variant, one and the same excitation element is suitable for operating successively or simultaneously at several different working frequencies. Such an element makes it possible to create a zone of coverage in which, for example, emission and reception are effected at different wavelengths. Such an excitation element is also suitable for effecting frequency switching.

The invention claimed is:

1. A multibeam antenna comprising:

a PBG material (Photonic Bandgap) suitable for the spatial and frequency-wise filtering of electromagnetic waves, this PBG material exhibiting at least one stopband and forming an exterior surface (38; 158) radiating in emission and/or in reception, at least one defect of periodicity of the PBG material in such a way as to create at least one narrow passband within said at least one stopband of this PBG material, and an excitation device suitable for emitting and/or receiving electromagnetic waves inside said at least one narrow passband created by said at least one defect, wherein:

the excitation device is suitable for working simultaneously at least around a first and a second distinct working frequency;

the excitation device comprises a first and a second distinct and mutually independent excitation element, each suitable for emitting and/or receiving electromagnetic waves, the first excitation element being suitable for working at the first working frequency and the second excitation element being suitable for working at the second working frequency;

the or each defect of periodicity of the PBG material forms a leaky resonant cavity exhibiting a constant height in a direction orthogonal to said exterior radiating surface, and determined lateral dimensions parallel to said exterior radiating surface;

the first and the second working frequencies are suitable for exciting the same resonant mode of a leaky resonant cavity, this resonant mode being established in an identical manner regardless of the lateral dimensions of the cavity, in such a way as to create on said exterior surface respectively a first and a second radiating spot, each of these radiating spots representing the origin of a beam of electromagnetic waves radiated in emission and/or in reception by the antenna, each of the radiating spots exhibits a geometrical center whose position is dependent on the position of the excitation element which gives rise thereto and whose surface area is greater than that of the radiating element giving rise thereto, and the first and the second excitation elements are placed one with respect to the other in such a way that the first and the second radiating spots are disposed on the exterior surface of the PBG material side by side and overlap partially.

2. The antenna as claimed in claim 1, wherein:

each radiating spot is substantially circular, the geometrical center corresponding to a maximum of power emitted and/or received and the periphery corresponding to a power emitted and/or received equal to a fraction of the maximum power emitted and/or received at its center, and the distance, in a plane parallel to the exterior surface, separating the geometrical centers of the two excitation elements, is strictly less than the radius of the radiating spot produced by the first excitation element plus the radius of the radiating spot produced by the second excitation element.

3. The antenna as claimed in claim 1, wherein the geometrical center of each radiating spot is placed on the line orthogonal to said exterior radiating surface and passing through the geometrical center of the excitation element giving rise thereto.

4. The antenna as claimed in claim 1, wherein the first and the second excitation elements are placed inside one and the same cavity.

5. The antenna as claimed in claim 4, wherein the first and the second working frequencies are situated inside the same narrow passband created by this same cavity.

6. The antenna as claimed in claim 1, wherein the first and the second excitation elements are each placed inside distinct resonant cavities, and the first and the second working frequencies are suitable for each exciting a resonant mode independent of the lateral dimensions of their respective cavity.

7. The antenna as claimed in claim 6, wherein it comprises a reflector plane of electromagnetic radiation associated with the PBG material, this reflector plane being deformed in such a way as to form said distinct cavities.

8. The antenna as claimed of claim 1, wherein the or each cavity is of parallelepipedal shape.

* * * * *